US009434590B2

(12) United States Patent
Miksovsky et al.

(10) Patent No.: US 9,434,590 B2
(45) Date of Patent: Sep. 6, 2016

(54) UTENSIL CARRYING CASE

(71) Applicant: humangear, Inc., San Francisco, CA (US)

(72) Inventors: Christopher A. Miksovsky, San Francisco, CA (US); Clint N. Slone, San Francisco, CA (US); Evelyne Chaubert, San Francisco, CA (US); Charlie Nghiem, Oakland, CA (US); Robert Charles Lane, Larkspur, CA (US); Jonathan Paul Downing, Belmont, CA (US)

(73) Assignee: humangear, Inc., San Francisco, CA (US)

( * ) Notice: Subject to any disclaimer, the term of this patent is extended or adjusted under 35 U.S.C. 154(b) by 372 days.

(21) Appl. No.: 14/204,919

(22) Filed: Mar. 11, 2014

(65) Prior Publication Data

US 2015/0257562 A1 Sep. 17, 2015

(51) Int. Cl.

| | |
|---|---|
| ***A47G 21/14*** | (2006.01) |
| ***B67B 7/44*** | (2006.01) |
| ***B67B 7/16*** | (2006.01) |
| ***A47G 21/06*** | (2006.01) |

(52) U.S. Cl.

CPC ..... *B67B 7/44* (2013.01); *A47G 21/06* (2013.01); *B67B 7/16* (2013.01)

(58) Field of Classification Search

CPC .... A47G 21/14; A47G 21/145; A47G 21/06; B67B 7/44

USPC ..... 206/553, 541, 372, 234, 223

See application file for complete search history.

(56) References Cited

U.S. PATENT DOCUMENTS

| | | | | | |
|---|---|---|---|---|---|
| D269,060 | S | | 5/1983 | Creamer | |
| 4,940,143 | A | * | 7/1990 | Stanfield | A45C 13/02 206/511 |
| 5,020,662 | A | * | 6/1991 | Aida | A45C 11/36 206/214 |
| 5,261,560 | A | * | 11/1993 | Wang | B65D 51/246 206/372 |
| 5,447,232 | A | * | 9/1995 | Chow | B65D 75/245 206/372 |
| 5,551,560 | A | * | 9/1996 | Weisburn | G11B 33/0427 206/308.1 |
| 5,705,212 | A | * | 1/1998 | Atkinson | B65D 51/247 206/542 |

(Continued)

OTHER PUBLICATIONS

To-Go Ware, Utensil Set, http://store-jfohpy.mybigcommerce.com/bamboo-utensils/, downloaded on Mar. 6, 2014.

(Continued)

*Primary Examiner* — Steven A. Reynolds

(74) *Attorney, Agent, or Firm* — Beyer Law Group LLP

(57) ABSTRACT

A clamshell style utensil carrying case includes a pair of housing members coupled together by a double hinge and latch. Each housing member has a support arranged to hold an associated utensil in place with the utensil heads facing in opposite directions. A support stand that projects from the double hinge spine holds a third utensil. In a closed position, the housing members encase the utensils. In an open position the utensils are displayed side by side with the third utensil optionally being elevated relative to the others. To help minimize the visual thickness of the case, the interior surface of each housing member may include a depression in the region adjacent the head end of its held utensil. The depressions form corresponding bulges in the exterior surfaces of their associated housing members. The bulges—which are located on opposite ends and opposite sides of the case—provide additional room for the utensil heads without unduly impacting the visual height of the case.

24 Claims, 11 Drawing Sheets

(56) References Cited

U.S. PATENT DOCUMENTS

| | | | | |
|---|---|---|---|---|
| 5,845,403 | A | 12/1998 | Nivin | |
| 5,954,203 | A * | 9/1999 | Marconi | B65D 43/162 206/464 |
| D414,988 | S | 10/1999 | Santini | |
| D530,985 | S | 10/2006 | Evans | |
| D575,593 | S | 8/2008 | Svartström | |
| D633,344 | S | 3/2011 | Nordwall | |
| 8,181,785 | B1 * | 5/2012 | Zeven | A45C 11/20 206/541 |
| 8,245,844 | B2 * | 8/2012 | Sorrentino | B65D 21/0202 206/362 |
| 9,139,349 | B2 * | 9/2015 | Lu | B65D 81/05 |
| 2003/0205493 | A1 * | 11/2003 | Chen | B25H 3/003 206/378 |
| 2014/0332439 | A1 * | 11/2014 | Glassman | A45F 5/00 206/553 |
| 2014/0339127 | A1 * | 11/2014 | Dao | B25H 3/006 206/553 |

OTHER PUBLICATIONS

Zelco Mangia, Portable 3-Piece Flatware Set, http://www.amazon.com/Zelco-Portable-3-Piece-Flatware-Service/dp/B0006VHM40/ref=sr_1_3?ie=UTF8&qid=1394071823&sr=8-3&keywords=portable+utensil+set, downloaded on Mar. 6, 2014.

Sistema, Cutlery to Go, http://sistemaplastics.com/products/to-go/cutlery-to-go, downloaded on Mar. 6, 2014.

Alpine, Faceplate Cases, http://www.ebay.com/bhp/alpine-face-plate-case, downloaded on Mar. 6, 2014.

* cited by examiner

UTENSIL CARRYING CASE

RELATED APPLICATIONS

This application is related to Design Application Ser. No. 29/484,453, filed on Mar. 10, 2014, which is incorporated herein by reference.

BACKGROUND

There are a number of circumstances where it may be desirable to carry a small set of utensils such as a knife, fork and spoon. The present invention relates generally to a utensil carrying case suitable for use in such circumstances and to specific utensils or a utensil set suitable for storage in such a case.

SUMMARY

In one aspect, a clamshell style utensil carrying case is described. The carrying case includes a pair of complementary housing members (e.g. upper and lower housing members) that are coupled together by a double hinge on one side and a latch that releasably secures free sides of the housing members. Each housing member has a utensil support arranged to hold an associated utensil (e.g., a spoon or fork) in place. Additionally, a support stand projects from a spine (web) portion of the double hinge and is arranged to hold a third utensil (e.g., a knife). When the casing is in a closed position the housing members encase the utensils, while in an open position the utensils may be displayed substantially side by side. In some preferred embodiments, the support stand holds the third utensil (e.g., knife) in an elevated position relative to the first and second utensils when the case is in the open position.

The utensil supports are preferably arranged such that the heads of their associated utensils face in opposite direction. To help minimize the visual thickness of the case the interior surface of each housing member may include a depression in the region adjacent the head end of its held utensil. The depressions form corresponding bulges in the exterior surfaces of the housing members. Since the head end of many utensils (e.g., spoons and forks) have an effective height that can be significantly greater than the thickness of the handle, the bulges—which are located on opposite ends and opposite sides of the case—provide additional room for the utensil heads without unduly impacting the visual height of the case.

In some embodiments, the hinges in the double hinge may take the form of living hinges and the case may be formed from a material conductive to the formation of living hinges such as polypropylene.

In some embodiments the support stand carried by the hinge spine includes a pair of projecting side walls arranged to hold the third utensil in place. The stand may optionally include a registration nub located between the projecting side walls that is arranged to position the third utensil relative to the stand. In one particular implementation, the registration nub is arranged to mate with a bottle opener feature in a knife held by the stand.

A separate described invention relates to a plastic knife with a bottle opener feature. Plastic that integrally forms the knife bland and handle is molded around a metal bottle opener feature to hold the bottle opener in place. The plastic knife may be formed from a variety of different materials. By way of example, glass filled nylon works well.

BRIEF DESCRIPTION OF THE DRAWINGS

The invention and the advantages thereof, may best be understood by reference to the following description taken in conjunction with the accompanying drawings in which:

FIG. 3(*b*) is an end elevational view of the utensil carrying case of FIG. 1 in the closed position.

FIG. 3(*c*) is a top perspective view of the utensil carrying case of FIG. 1 in the closed position.

FIG. 3(*d*) is a bottom perspective view of the utensil carrying case of FIG. 1 in the closed position.

In the drawings, like reference numerals are sometimes used to designate like structural elements. It should also be appreciated that the depictions in the figures are diagrammatic and not to scale.

DETAILED DESCRIPTION OF THE PREFERRED EMBODIMENTS

The present invention relates generally to utensil carrying cases and utensil sets included with such carrying cases. In another aspect a novel knife is described.

Figure 1:
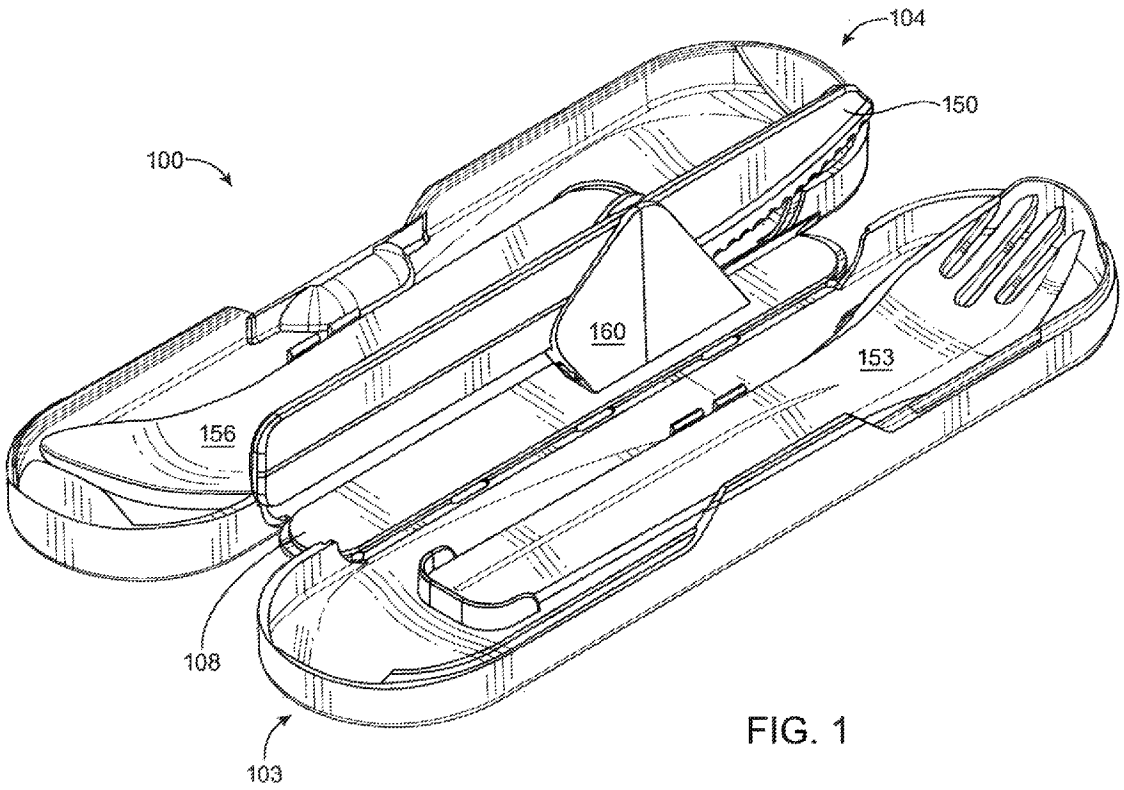
FIG. 1 is a perspective view of a utensil carrying case in accordance with one embodiment of the invention.
Figure 2:
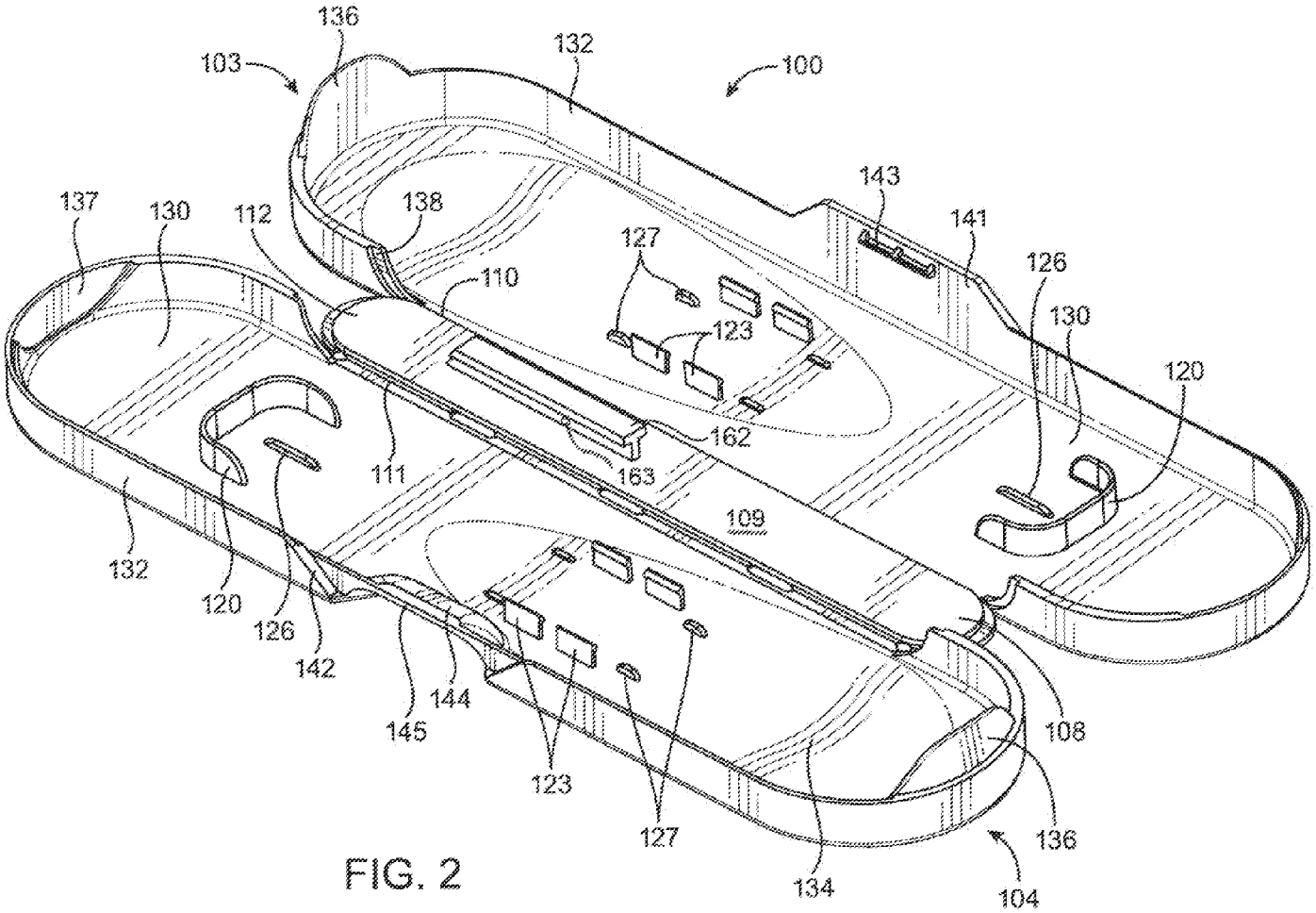
FIG. 2 is a perspective view of the utensil carrying case of FIG. 1 without the utensils stored therein and before the support stand is attached.
Figure 3A:
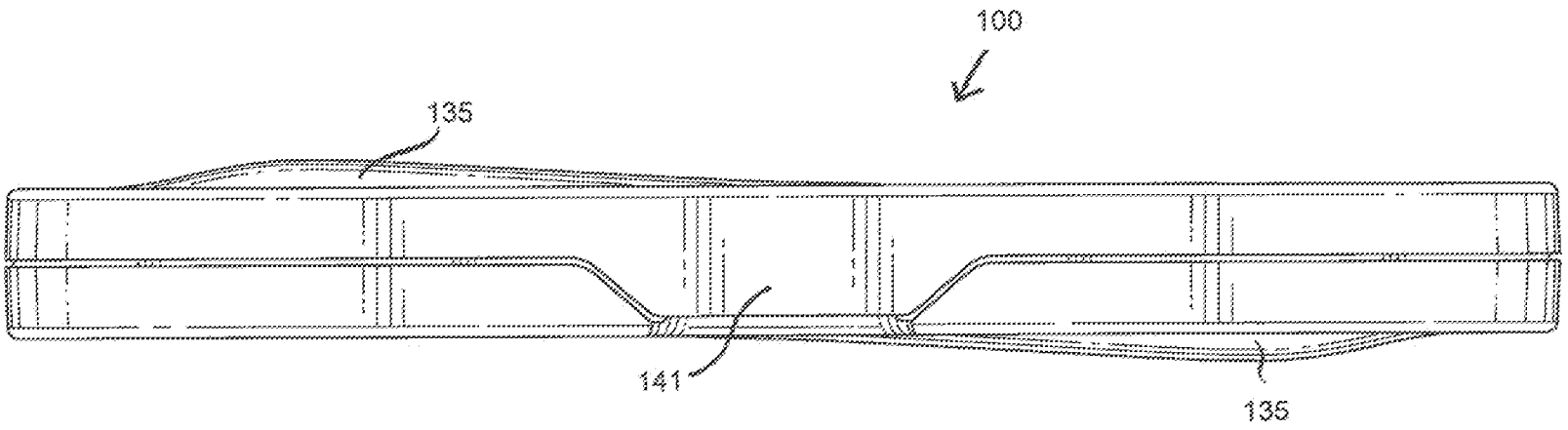
FIG. 3(*a*) is a front side elevational view of the utensil carrying case of FIG. 1 in the closed position.
Figure 3B:
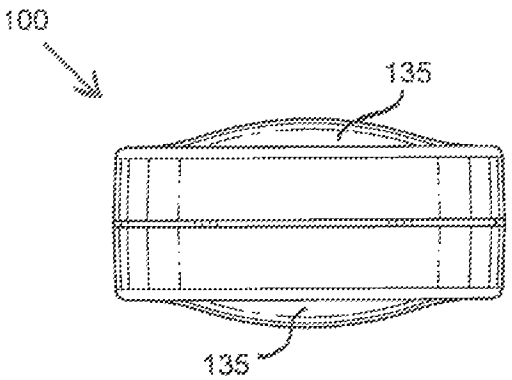
Figure 3C:
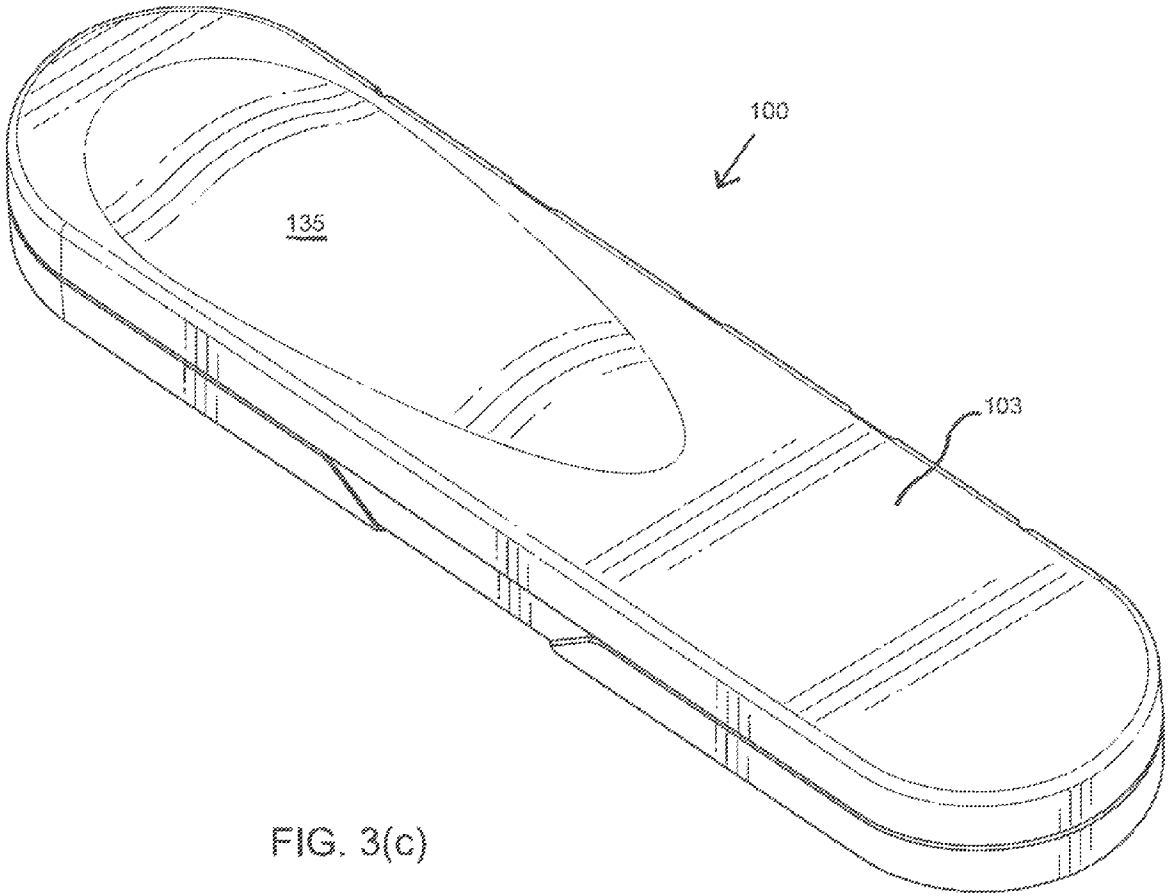
Figure 3D:
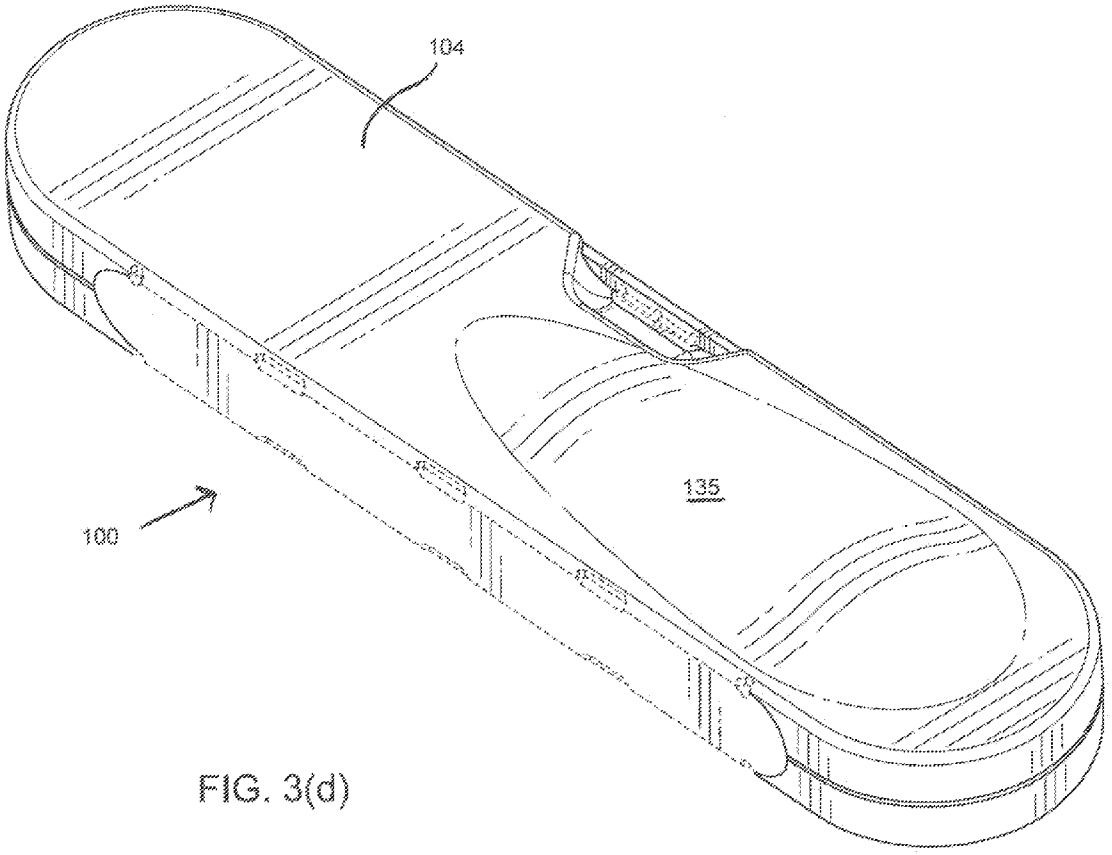
Figure 4:
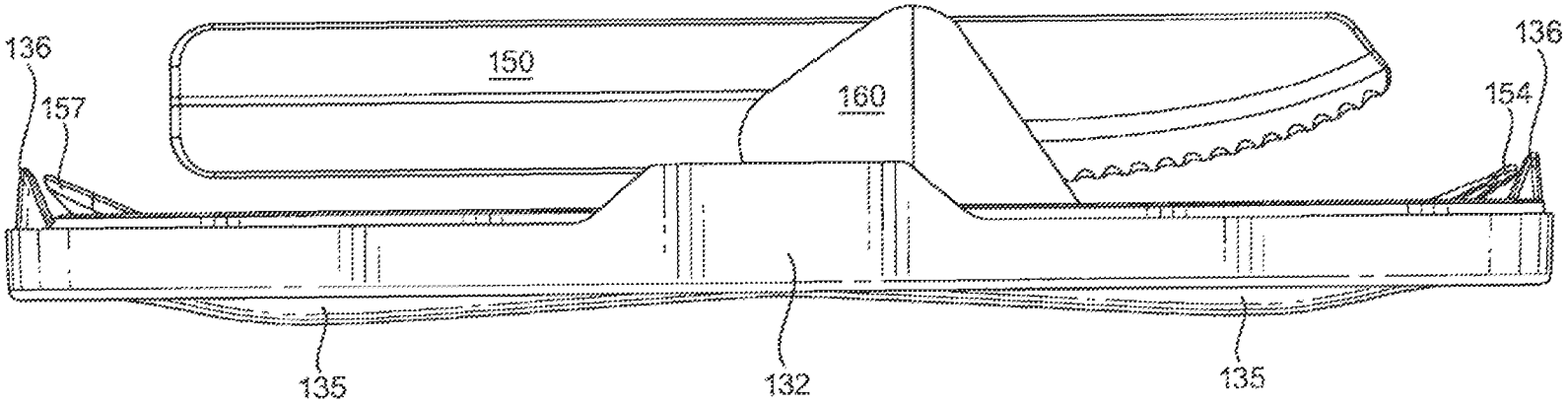
FIG. 4 is a front side elevational view of the utensil carrying case of FIG. 1 in the open position.

FIG. 1 is a perspective view of an open carrying case 100 that contains a knife 150, a fork 153 and a spoon 156. The knife 150 is supported on a utensil support stand 160. FIG. 2 is a perspective view of the open carrying case 100 without the utensils 150, 153 and 156 and with the utensil support stand 160 removed. FIGS. 3(*a*)-3(*d*) are side, end, top perspective and bottom perspective views respectively of the carrying case in a closed position illustrating its relatively thin visual appearance. FIG. 4 is a side view of the carrying case in an open position.

The carrying case 100 includes a pair of housing members 103, 104 that are pivotally coupled by a double hinge 108. The double hinge 108 carries a stand pedestal 162 onto which the support stand 160 may be placed. The housing members each include a base or floor 130, a sidewall 132, and a depression 134 in the floor 130 in the region where the head of a utensil such as spoon 156 or fork 153 is expected to rest. The depressions 134 on the interior surface of the housing floor provide corresponding bulges 135 on the exterior surface of the housing members 102, 104 as seen in FIGS. 3 and 4. Each housing member 103, 104 also includes a number of utensil support features including handle guide 120, snap catches 123 and positioning features 126, 127 which in the illustrated embodiment take the form of small ridges or nubs.

During use, a utensil such a fork 153 or spoon 156 is set in each housing member 103, 104. The head of utensil is placed in the region of depression 134 and the handle extends towards handle guide 132. The longitudinal position of the spoon and fork is constrained by handle guide 120 on one end, and a utensil head stop 136 on the other. The utensil head stop 136 is formed as an integral extension of the sidewall 132 at one end of each housing member 103, 104. The spacing and positioning of the snap catches 123 is such that when the spoon or fork is properly placed in the housing member, the handle will snap into the snap catches 123 to thereby hold the utensil in place.

It should be appreciated that the height of the head end of the spoon 156 and fork 153 relative to the longitudinal axes of the utensils is substantially greater than the thicknesses of their handles. The geometry of the spoon and fork is such that their head ends dip below the centerline of the handle near the junction of the handle and head, and then extend significantly above the centerline towards the distal tip, with the distal tips 154, 157 having the greatest deviation from the centerline.

The carrying case 100 is designed to have a visually thin appearance and there are several features that contribute to the relatively thin appearance. Initially, it can be seen that the utensils 153, 156 are oriented with their heads located at opposite ends of the case 100. The spoon and fork are positioned such that their distal tips 154, 157 extend beyond the ends of the knife 150. Since the tips 154, 157 don't overlap with either the knife 150 or each other, the case 100 can be made thinner than would be needed if there was such overlap. Furthermore, the depressions/bulges 134, 135 are gently rounded in two dimensions to present pleasant visual lines with the apex of the depressions being located in the region where the lowest part of the utensil head is expected to rest. This allows a still thinner case over the vast majority of the case's surface area since the depressions/bulges are positioned only where the extra thickness is needed. The depressions/bulges are also positioned inwards from the periphery of the case so that from many angles (e.g. looking downwards on the case) the viewer only sees the primary sides of the housing members and not the bulges, which can further add to the perceived visual thinness. Minimizing the edge thickness of the case also helps the case easily slide into a container such as a backpack or pocket purse.

The shape of the budges may vary in accordance with the needs of a particular design. Preferably, the bulges are localized and do not extend to any of the edges of the case and do not extend significantly past the lengthwise centerline of the case so they only minimally overlap vertically. In other embodiments, the bulges may be arranged such that they do not extend past the lengthwise centerline such that there is no vertical overlap. These aspects help reduce the edge thickness, the overall thickness and the visual thicknesses of the case. For visual enhancement, the bulges may taper more slowly from the apex towards the casing centerline than they do towards the end and side edges as can be seen in FIGS. 3(*a*)-3(*c*) and 4.

The housing members 103 and 104 may also include various positioning features 126 and 127 to help position the utensils 153, 156 relative to the housing members. In the illustrated embodiment, positioning ridge 126 is located adjacent the handle guide 120 to lift the proximal end of spoon/fork handle off of the floor 130. Slightly raising the handle in this manner helps lower the distal tips 157, 154 of the spoon and fork. The nubs also elevate the handles of the utensils slightly off the floors of the housing members so that a user is more easily able to grab the handles when removing the utensils. Positioning nubs 127 are arranged to serve as supports that cooperate with snap catches 123 to tightly hold the utensils in place. It should be appreciated that the geometry of the positioning features can be widely varied without diminishing their effectiveness.

In the illustrated embodiment, each utensil is held in place by two sets of opposing snaps. This was done so that if one snap were to be broken off, there would still be a second set to hold the utensil in place. Two sets of snaps also permits the use of snaps having a reduced holding force per individual snap. This means snap deflection is minimized and snap life maximized. Although two sets of snaps are illustrated, it should be appreciated that in other embodiments, there could simply be one set of snap per utensil, or more than two.

The housing members 103 are coupled by a double hinge 108. The double hinge includes a "spine" or "web" 109 between a pair of hinges 110, 111 that are coupled to the housing members 103, 104 respectively. The hinges 110, 111 may take any suitable form. In the illustrated example, the hinges are living hinges that are integrally formed from plastic with the housing members and the hinge spine 109.

In the illustrated embodiment, a stand pedestal 162 is integrally formed on the hinge spine 162. The stand pedestal 162 takes the form of a T-shaped rail and includes a stand locking feature 163. Knife support stand 160 is mounted on stand pedestal 162 by sliding onto the T-shaped rail and has a complementary locking feature so that when positioned, the support stand 160 is securely (and preferably permanently) attached to stand pedestal 162. Thus, the knife support stand is secured to and carried by the web of the double hinge 108. Knife 150 can be attached to the support stand 160 in an orientation in which its height is substantially perpendicular to the major plane of the web as illustrated in FIGS. 1 and 4. Thus, when the case 100 is opened substantially flat as shown in those figures, the knife 150 is elevated relative to the spoon and fork and extends substantially perpendicularly relative to the spoon and fork. When the case is closed, the knife is interleaved between the spoon and fork in a generally parallel manner.

The actual geometries of the knife, spoon and fork may be widely varied and in other embodiments, other utensils may be stored in place of, or in addition to, one or more of the illustrated knife, spoon and fork. By way of example, particular spoon and fork geometries are described in concurrently filed U.S. patent application Ser. No. 14/204,497, which is incorporated herein by reference.

Figure 5:
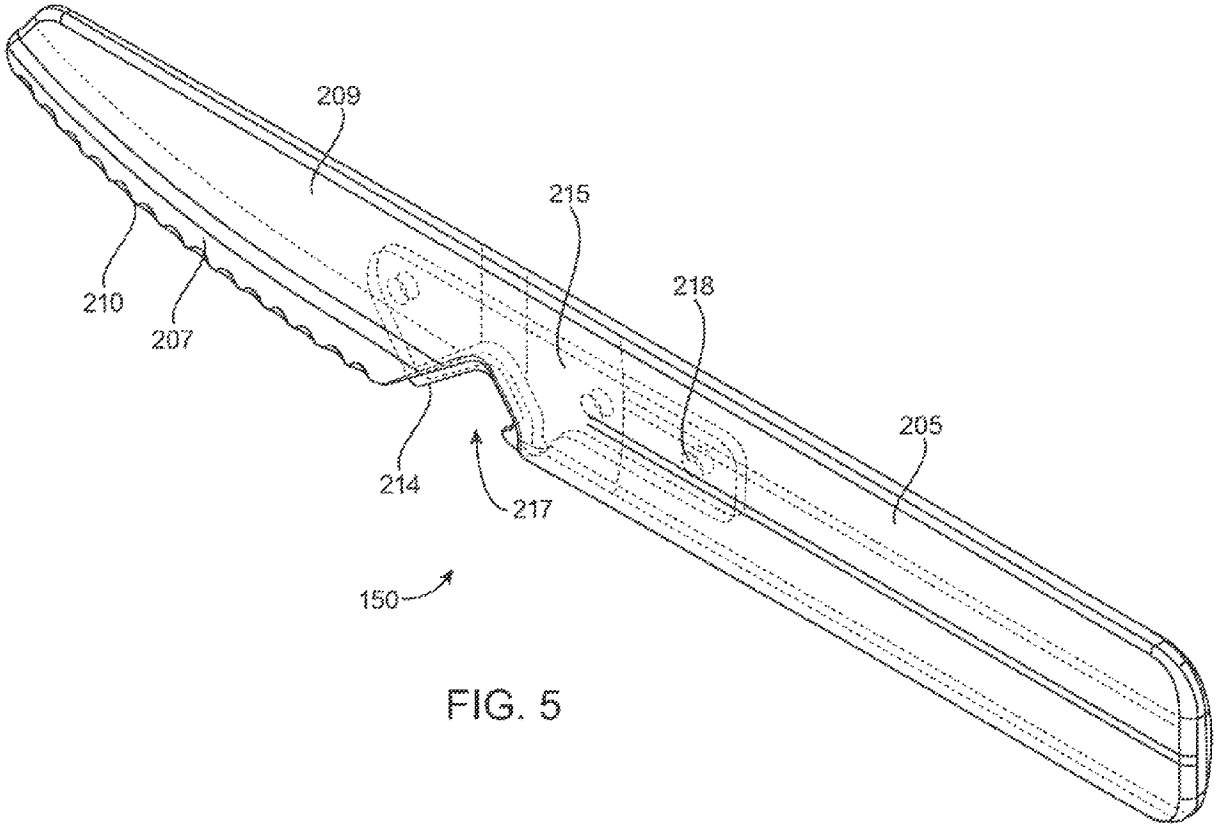
FIG. 5 is a perspective view of a knife.

A particular knife design 150 that is well suited for use with the carrying case 100 is illustrated in FIG. 5, although again, a wide variety of other knife geometries may be used. Knife 150 includes a handle 205, a blade 207 and a bottle opener 214 positioned at or near the junction of the handle and blade. The illustrated blade 207 has a spine 209 and a serrated cutting edge 210, although that is not a requirement. The handle and blade portions of the knife may be integrally formed from a strong plastic material—as for example, a glass reinforced thermoplastic such glass filled nylon etc. The bottle opener 214 is formed from a metal insert 215 (shown in dotted lines) that is molded into the knife handle/blade during molding of the knife. The insert 215 includes bottle opener feature 214 that is exposed and forms a recess 217 at a middle portion of the knife. The insert 215 may also include a plurality of through-holes 218 that allow plastic to flow therethrough to better secure the insert to the plastic knife. The bottle opener 214 serves dual purposes. In addition to the bottle opener functionality, the recess 217 provided by the bottle opener serves as a registration feature that can be used to align the knife on knife stand 160.

Figure 6:
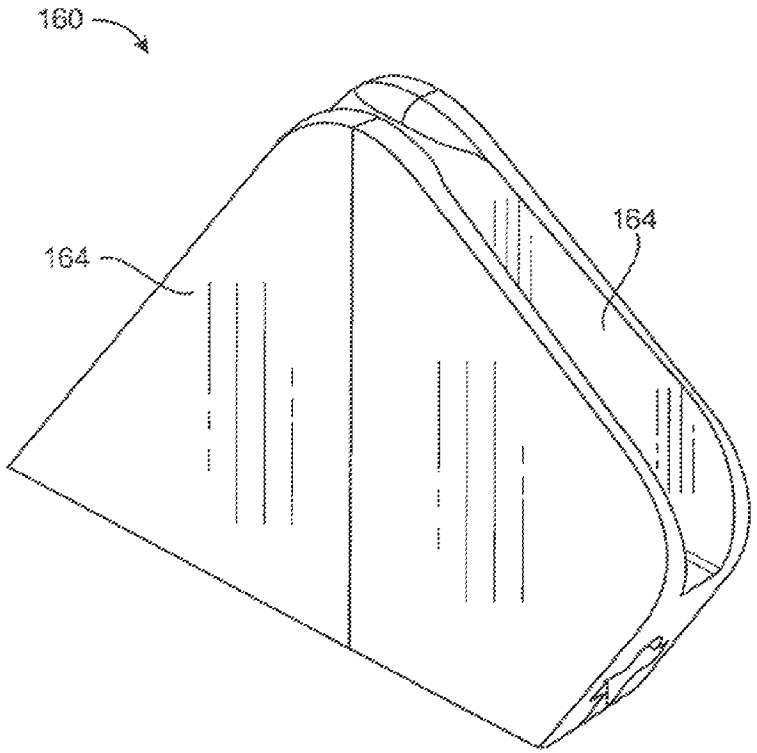
FIG. 6 is a perspective view of the utensil support stand.
Figure 7:
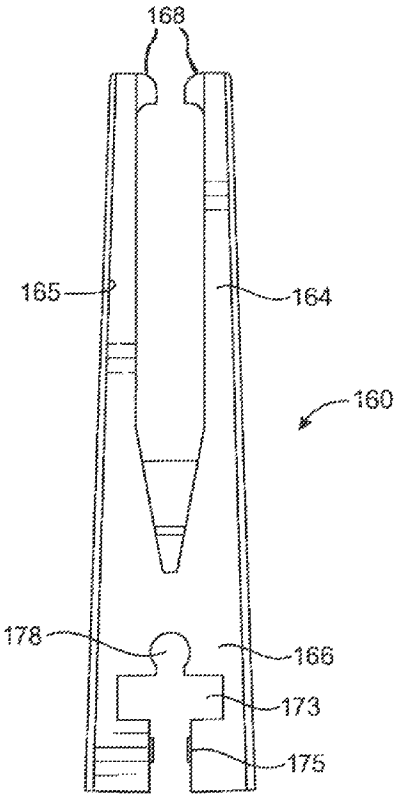
FIG. 7 is a side elevational view of the utensil support stand of FIG. 6.

Referring next to FIGS. 6 and 7, one particular knife support stand geometry will be described. The illustrated knife support stand 160 includes a pair of side walls 164, 165 that extend upward from a base 166 forming a slot 167 therebetween. The walls longitudinally taper towards the top and have opposing projections 168 that extend inward to form a catch that cooperates with the base 166 and the side walls 164, 165 to hold the knife in place. The elasticity of side walls 164, 165 allows a knife shaft to be pushed downward into the stand past the projections 168 with the projections 168 springing back to catch the knife thereby holding it in place on the stand. The projections 168 are preferably rounded to facilitate easy insertion and removal of the knife onto/from the stand 160.

Figure 8:
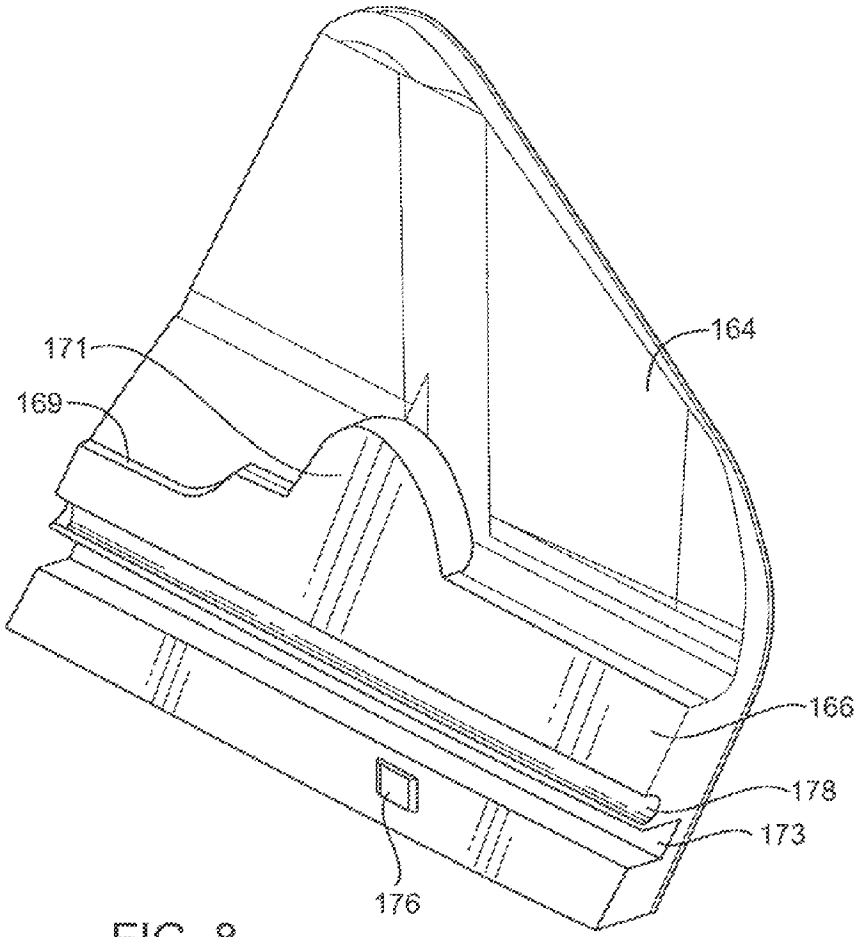
FIG. 8 is a cut-away perspective view of the utensil support stand of FIG. 6.

FIG. 8 is a side facing cut-away view of the stand. As seen therein, the slot 167 within base 166 has a floor surface 169 that may be contoured to roughly match the contours of the knife. A registration hump 171 is provided on the floor surface 169. The registration hump 171 is configured to mate with the recess 217 formed by bottle opener 214 to properly position the knife on the stand. This helps prevent the knife from being placed on the stand at a location that extends too far toward one end or the other such that it could interfere with the tips of the spoon or fork. In the orientation of FIG. 8, the floor 169 is lower towards the left side of the base to accommodate the proximal part of blade 207. The height of the floor 169 to the right side of the registration hump 171 is configured to support the handle 205. When the knife is properly positioned, the recess 217 slides over registration hump 217 to position the knife on the stand. Thus, the registration hump 171 and floor topology of the stand 160 cooperate to properly position knife in the case 100 relative to the fork and spoon.

In the illustrated embodiment, the knife support stand 160 is formed independently of the rest of the housing member for ease of manufacturing reasons. In other embodiments, the stand can be integrally formed with the housing members 103, 104 or formed from multiple independent parts that are later assembled. In the illustrated embodiment, the base stand 166 includes a cross shaped channel 173 that is arranged to mate with T-shaped pedestal 162. The channel and pedestal have complementary snap locking features 175, 176 that are arranged to permanently secure the stand 160 to the pedestal 162 when assembled. The somewhat circular portion 178 at the top of the cross shaped channel 173 forms a substantially circular channel when the stand is assembled. This channel may be used as a toothpick holder to secure a toothpick (not shown) to the stand 160.

The side walls 132 of the housing members 103, 104 have several noteworthy features as well. A best seen in FIG. 2, the sidewall 132 is cut away adjacent the double hinge and is arranged so that the hinge web/spine 109 forms an edge of the case 100 when the case is closed. The ends 112 of the spine may be thinned to a half thickness and match with complementary thinned recesses 138 in the side walls so that the web registers against the sidewall in a manner that forms a continuous flush side edge of the case when the case is closed. The sidewall 132 of each housing member has a utensil head stop 136 on one end and a head stop recess 137 on the inner surface of the other end. Both the head stops 136 and the head stop recesses 137 are substantially half thickness. The head stops and head stops recesses are complementary so that the head stop of each housing member will nest into the head stop recess of the other in a hidden manner when the case is closed. The head stops are sized to be higher than the tips of the spoon or the fork to thereby prevent the utensil from sliding "forwards".

Housing member 103 has a tab 141 that extends downward into a corresponding cut-out 142 in the sidewall 132 in opposing housing member 104. The tab 141 includes a latch bar 143 on its inner surface. Housing member 104 has a finger recess 144 behind the cut-out 142. The latch bar 143 snaps over the top wall 145 of finger recess 144 when the case is closed to snap the case shut. The case can readily be opened by pulling the tab 141 outward and upward so that the latch bar moves free of the top wall 145 of finger recess 144. This structure provides a latch mechanism for securing the case in the closed position. The tab 141 and cutout 142 cooperate with the sidewalls 132 of the housing member 103, 104 to present a smooth and flush side edge for the case in the closed position.

The case 100 may be formed from a wide variety of materials. By way of example, a variety of thermoplastic materials such as polypropylene work well and permit the use of low cost, injection or transfer molding manufacturing processes that can produce durable and attractive looking cases. Of course a wide variety of other materials can be used as well. When living hinges are used, it is particularly desirable to utilize a material that is durable and otherwise well suited for use as the hinge material. Again, polypropylene works well although other materials can readily be used as well.

Although only a few embodiments of the invention have been described in detail, it should be appreciated that the invention may be implemented in many other forms without departing from the spirit or scope of the invention. The embodiment illustrated in FIG. 1 includes a knife, a spoon and a fork. Although this combination is expected to be most common, it should be appreciated that the described case can be used to hold a variety of different utensils and combinations of utensils.

Specific structures have been shown for various components such as the double hinge, the utensil supports, the support stand, the latch, the utensil head stops, etc. Although these structures work well, it should be appreciated that a wide variety of alternative or equivalent structures can readily be used in their place. Therefore, the present embodiments should be considered illustrative and not restrictive and the invention is not to be limited to the details given herein, but may be modified within the scope and equivalents of the appended claims.

What is claimed is:

1. A utensil set comprising a utensil carrying case and first, second and third eating utensils, the utensil carrying case comprising:

a first housing member having a first utensil support, the first utensil support securing and positioning the first eating utensil relative to the first housing member;

a second housing member having a second utensil support, the second utensil support securing and positioning the second eating utensil relative to the second housing member;

a double hinge that pivotally couples the first and second housing members together, the double hinge including a web, a first hinge portion that pivotally couples the web to the first housing member and a second hinge portion that pivotally couples the web to the second housing member;

a utensil support stand carried by and projecting from the web, the utensil support stand securing and positioning the third eating utensil;

a casing latch for releasably securing a free side of the first housing member to a free side of the second housing member;

wherein the first and second housing members of the utensil carrying case are arranged to be moved between, (i) a closed position in which the casing latch secures the free sides of the first and second housing members together to form an enclosure capable of enclosing the first, second and third eating utensils, and (ii) an open position capable of displaying the first second and third eating utensils substantially side by side.

2. A utensil set as recited in claim 1 wherein the utensil supports are arranged to hold the first and second eating utensils such that head portions of the first and second utensils are located at opposite ends of the carrying case.

3. A utensil set as recited in claim 1 wherein the first and second housing members each include an interior surface and an exterior surface, the interior surface including a depression that forms a corresponding bulge in the exterior surface, the depression being arranged to receive a portion of a head portion of a eating utensil held by the associated utensil support.

4. A utensil set as recited in claim 3 wherein the bulges in the first and second housing members are offset such that they are located at different ends of the utensil carrying case and the first and second utensil supports are arranged such that the head portions of the first and second eating utensils face in opposite directions.

5. A utensil set as recited in claim 1 wherein the first and second utensil supports each include fittings arranged to hold the handle of an associated retained utensil to secure the retained utensil to the carrying case and to longitudinally constrain an end portion of a handle of the associated retained utensil.

6. A utensil set as recited in claim 1 wherein the utensil support stand holds the third eating utensil in an elevated position relative to the first and second eating utensils when the case is in the open position.

7. A utensil set as recited in claim 1 wherein the first and second hinge portions are living hinges.

8. A utensil set as recited in claim 1 wherein the casing latch is located opposite the double hinge to facilitate securing the first and second housing members in a closed position.

9. A utensil set as recited in claim 1 wherein the utensil support stand includes a pair of projecting side walls arranged to hold the third eating utensil in place.

10. A utensil set as recited in claim 9 wherein the utensil support stand further comprises a registration nub located between the projecting side walls and arranged to position the third eating utensil relative to the utensil support stand.

11. A utensil set as recited in claim 10 wherein the utensil support stand is arranged to hold a knife having an integrated bottle opener feature between a handle portion of the knife and a blade portion of the knife, and wherein the registration nub is arranged to mate with the bottle opener feature.

12. A utensil set as recited in claim 1 wherein the utensil support stand further includes a toothpick holder arranged to hold a toothpick.

13. A utensil set as recited in claim 1 wherein the first and second housings each have a base and a sidewall that projects from the base, and wherein each sidewall includes an integrally formed utensil head stop that projects further from the base than other portions of the sidewall, the utensil head stops being arranged to longitudinally constrain a head portion of an associated retained utensil.

14. A utensil set as recited in claim 1 wherein the utensil carrying case is formed from polypropylene.

15. A utensil set comprising a clamshell utensil style carrying case, a spoon, a fork, and a knife, and wherein the clamshell style utensil carrying case comprises:

a first housing member having a first utensil support, the first utensil support being arranged to secure and position the spoon relative to the first housing member;

a second housing member having a second utensil support, the second utensil support being arranged to secure and position the fork relative to the second housing member;

a double hinge that pivotally couples the first and second housing members together, the double hinge including a web, a first hinge portion that pivotally couples the web to the first housing member and a second hinge portion that pivotally couples the web to the second housing member;

a utensil support stand carried by and projecting from the web, the utensil support stand being arranged to hold the knife;

a casing latch for releasably securing a free side of the first housing member to a free side of the second housing member;

wherein the first and second housing members of the clamshell style utensil carrying case are arranged to be moved between, (i) a closed position in which the casing latch secures the free sides of the first and second housing members together to form an enclosure capable of enclosing the spoon, fork and knife, and (ii) an open position capable of displaying the spoon, fork and knife substantially side by side.

16. A utensil set comprising a utensil carrying case and first and second eating utensils, the utensil carrying case comprising:

a first housing member having a first utensil support, the first utensil support securing and positioning the first eating utensil relative to the first housing member;

a second housing member having a second utensil support, the second utensil support securing and positioning the second eating utensil relative to the second housing member, wherein the first and second utensil supports are arranged to hold the first and second eating utensils such that head portions of the first and second eating utensils are respectively located at opposite ends of the carrying case;

a hinge that pivotally couples the first and second housing members together;

a casing latch for releasably securing a free side of the first housing member to a free side of the second housing member; and wherein the first and second housing members of the utensil carrying case are arranged to be moved between, (i) a closed position in which the casing latch secures the free sides of the first and second housing members together to form an enclosure capable of enclosing the first and second eating utensils, and (ii) an open position capable of displaying the first and second eating utensils substantially side by side; and wherein the first and second housing members each include an interior surface and an exterior surface, the interior surface including a depression that forms a corresponding bulge in the exterior surface, the depression being arranged to receive a portion of a head portion of a utensil held by the associated utensil support, the bulges in the first and second housing members being offset such that they are located at different ends of the utensil carrying case and on different sides of the utensil carrying case when the case is in the closed position.

17. A utensil set as recited in claim 16 wherein the first and second utensil supports each include fittings arranged to hold the handle of an associated retained utensil to secure the retained utensil to the carrying case and to longitudinally constrain an end portion of a handle of the associated retained utensil.

18. A utensil set as recited in claim 16 wherein the hinge is a double hinge having a web, a first hinge portion that pivotally couples the web to the first housing member and a second hinge portion that pivotally couples the web to the second housing member, the first and second hinge portions being living hinges.

19. A utensil set as recited in claim 16 wherein the first and second housings each have a base and a sidewall that projects from the base, and wherein each sidewall includes an integrally formed utensil head stop that projects further from the base than other portions of the sidewall, the utensil head stops being arranged to longitudinally constrain a head portion of an associated retained utensil.

20. A utensil set comprising a spoon having a spoon handle and a spoon head, a fork having a fork handle and a fork end, a knife, and a utensil carrying case comprising:

first and second housing members, each housing member having an associated utensil support, each utensil support being arranged to secure and position the spoon or fork relative to the associated housing member;

a double hinge that pivotally couples the first and second housing members together, the double hinge including a spine, a first hinge that pivotally couples the spine to the first housing member and a second hinge that pivotally couples the spine to the second housing member;

a knife support stand carried by and projecting from the double hinge spine, the knife support stand being arranged to hold the knife;

a casing latch located opposite the double hinge for releasably securing a free side of the first housing member to a free side of the second housing member to facilitate securing the first and second housing members in a closed position; and wherein the first and second housings of the utensil carrying case are arranged to be moved between, (i) a closed position in which the casing latch secures the free sides of the first and second housing members together to form an enclosure capable of enclosing the knife, spoon and fork, and (ii) an open position in capable of displaying the knife, spoon and fork first substantially side by side, with the knife support stand holding the knife held in an elevated position relative to the spoon and fork.

21. A utensil set as recited in claim 20 wherein:

the utensil supports are arranged to hold the spoon and fork such that the head portions of the spoon and fork are located at opposite ends of the carrying case; and the first and second hinge portions are living hinges.

22. A utensil set as recited in claim 21 wherein:

the first and second housing members each include an interior surface and an exterior surface, the interior surface including a depression that forms a corresponding bulge in the exterior surface, the depression being arranged to receive a portion of a head portion of the spoon or fork held by the associated utensil support, wherein the bulges in the first and second housing members are offset such that they are located at opposite ends of the utensil carrying case; and the first and second utensil supports each include (i) snap fittings arranged to hold the handle of the associated retained spoon or fork to secure the retained spoon or fork to the carrying case, and (ii) a handle stop arranged to longitudinally constrain an end portion of a handle of the held spoon or fork.

23. A utensil set as recited in claim 20 wherein the knife support stand includes:

a pair of projecting side walls arranged to hold the knife in place; and a registration nub located between the projecting side walls and arranged to engage a mating recess structure on the knife to position the knife relative to the utensil support stand.

24. A utensil set as recited in claim 23 wherein the knife is formed from plastic and includes an integrated metal bottle opener feature between a handle portion of the knife and a blade portion of the knife, and wherein the registration nub is arranged to mate with the metal bottle opener feature.

* * * * *